US006676828B1

(12) United States Patent
Galiasso et al.

(10) Patent No.: US 6,676,828 B1
(45) **Date of Patent: *Jan. 13, 2004**

(54) PROCESS SCHEME FOR SEQUENTIALLY TREATING DIESEL AND VACUUM GAS OIL

(75) Inventors: Roberto Galiasso, San Antonio (VE); Eusebio Palmisano, Caracas (VE); Gerardo Arreaza, Caracas (VE); Samuel Quenza, Turmero (VE); Sandra Ramnarine, Caracas (VE)

(73) Assignee: Intevep, S.A., Caracas (VE)

( * ) Notice: Subject to any disclaimer, the term of this patent is extended or adjusted under 35 U.S.C. 154(b) by 540 days.

This patent is subject to a terminal disclaimer.

(21) Appl. No.: 09/626,371

(22) Filed: Jul. 26, 2000

(51) Int. Cl.[7] ..... C10G 65/02; C10G 65/10; C10G 65/12

(52) U.S. Cl. ..... 208/58; 208/59; 208/61; 208/311; 208/339; 208/341

(58) Field of Search ..... 208/58, 59, 61, 208/311, 339, 341

(56) References Cited

U.S. PATENT DOCUMENTS

| | | | | |
|---|---|---|---|---|
| 3,733,260 A | | 5/1973 | Davies et al. | 208/212 |
| 4,414,103 A | | 11/1983 | Farrell | 208/212 |
| 4,424,117 A | | 1/1984 | Kuno | |
| 4,822,480 A | | 4/1989 | Harandi et al. | 208/212 |
| 4,954,241 A | | 9/1990 | Kukes et al. | 208/59 |
| 5,110,444 A | | 5/1992 | Haun et al. | 208/89 |
| 5,114,562 A | | 5/1992 | Haun et al. | 208/89 |
| 5,447,621 A | | 9/1995 | Hunter | 208/58 |
| 5,968,347 A | | 10/1999 | Kolodziej et al. | |
| 5,980,729 A | | 11/1999 | Kalnes et al. | |
| 6,444,116 B1 | * | 9/2002 | Galiasso et al. | 208/58 |

* cited by examiner

*Primary Examiner*—Walter D. Griffin
(74) *Attorney, Agent, or Firm*—Bachman & LaPointe, P.C.

(57) ABSTRACT

A process for treating a vacuum gas oil and Diesel feed includes the steps of providing reaction feed containing vacuum gas oil, Diesel and sulfur-containing compounds; providing a stripping gas; providing a washing feed; and mixing the reaction feed, the stripping gas and the washing feed in a stripping and washing zone so as to obtain a gas phase containing the sulfur-containing compounds and a liquid phase substantially free of the sulfur-containing compounds. The washing feed comprises at least one of Diesel, light vacuum gas oil and mixtures thereof produced in the process or added from external source.

14 Claims, 4 Drawing Sheets

PROCESS SCHEME FOR SEQUENTIALLY TREATING DIESEL AND VACUUM GAS OIL

BACKGROUND OF THE INVENTION

The invention relates to a high temperature and high pressure stripping and washing process which is excellent for use in separating portions of a feedstock between two high pressure reaction zones. More particularly, the invention relates to a high pressure, high temperature stripping and washing process which is well suited as an intermediate step in processes for treating Diesel and vacuum gas oil feeds so as to provide an FCC feedstock having reduced sulfur content and a Diesel fuel product having reduced sulfur content and enhanced cetane number.

Many refineries hydrotreat virgin and cracked feedstocks in order to obtain upgraded gasoline and Diesel products. These refineries utilize high-pressure units. High pressure hydrodesulfurization (HDS) units can be utilized with cracked vacuum gas oil (VGO), and when operated between 700–1200 psig, can achieve HDS conversion rates of greater than 99% so as provide a product having a sulfur content between 0.002 and 0.12% wt. This product can then be fed to a fluid catalytic cracking (FCC) process to produce gasolines and Diesel fuels with sulfur content less than 150 ppm and 600 ppm respectively. Unfortunately, the Diesel fraction produced in an FCC process from such a VGO feed typically has a cetane number of only about 20–30, which prevents this product from being incorporated into the Diesel pools. In order to be used, this Diesel fraction must be treated with additional hydrotreating steps. In addition, numerous other Diesel streams are readily available in the refineries such as straight run kerosene and Diesel, thermal cracked Diesel and the like, all of which have high sulfur content and typically medium cetane number that will require an additional deep hydrotreatment.

Conventional low-medium pressure Diesel hydrotreatment can satisfactorily reduce the sulfur content, but provides only small improvements in cetane number, in the range of 2–4 point increments.

Typical catalysts for use in hydrotreating to increase cetane number are extremely sensitive to even small amounts of sulfur, and therefore cannot readily be incorporated into an HDS reactor.

Alternatives for processing in order to attempt to address the sulfur and cetane number objectives include two-stage hydroprocessing. Unfortunately, conventional two-stage processing requires a separation to be carried out between the stages, and conventional separation processes are carried out at low temperature, low pressure, or both, resulting in the need for additional compression systems, one for each stage, which can double equipment and operation costs.

It is clear that the need remains for a method for treating VGO feedstocks and other Diesel feedstocks so as to advantageously reduce sulfur while improving cetane number. Further, the need remains for a process whereby separation of components is achieved at high temperature and pressure so as to avoid the need for additional compression equipment and the like.

It is therefore the primary object of the present invention to provide a process whereby VGO and Diesel feedstocks can advantageously and economically be converted into valuable end products.

It is another object of the invention to provide a process which can advantageously find use in revamping actual facilities or building new ones.

It is a further object of the invention to provide a process for high pressure and high temperature separation to produce an intermediate feedstock which can be blended with an external Diesel component to be sequentially treated in a Diesel hydrotreating stage.

Other objects and advantages will appear herein below.

SUMMARY OF THE INVENTION

In accordance with the present invention, the foregoing objects and advantages have been readily attained.

According to the invention, a process is provided for sequentially hydrotreating vacuum gas oil and Diesel, which process comprises the steps of providing a reaction feed containing vacuum gas oil, Diesel and sulfur-containing compounds; providing a stripping gas; providing a washing feed; and mixing said reaction feed, said stripping gas and said washing feed in a stripping and washing zone so as to obtain a gas phase containing said sulfur-containing compounds and a liquid phase substantially free of said sulfur-containing compounds, wherein said reaction feed is provided at a reaction feed pressure of between about 700 psig and about 1300 psig, and wherein said stripping and washing zone is operated at a pressure within about 50 psig of said reaction feed pressure.

The hydrodesulfurization and hydrotreating reactors, as well as the stripping/washing separator, are advantageously operated at substantially the same pressure, and preferably substantially the same temperature, thereby avoiding the need for additional compressor equipment between stages and limiting the need for additional heating between stages as well.

BRIEF DESCRIPTION OF THE DRAWINGS

A detailed description of preferred embodiments of the present invention follows, with reference to the attached drawings, wherein.

DETAILED DESCRIPTION

Figure 1:
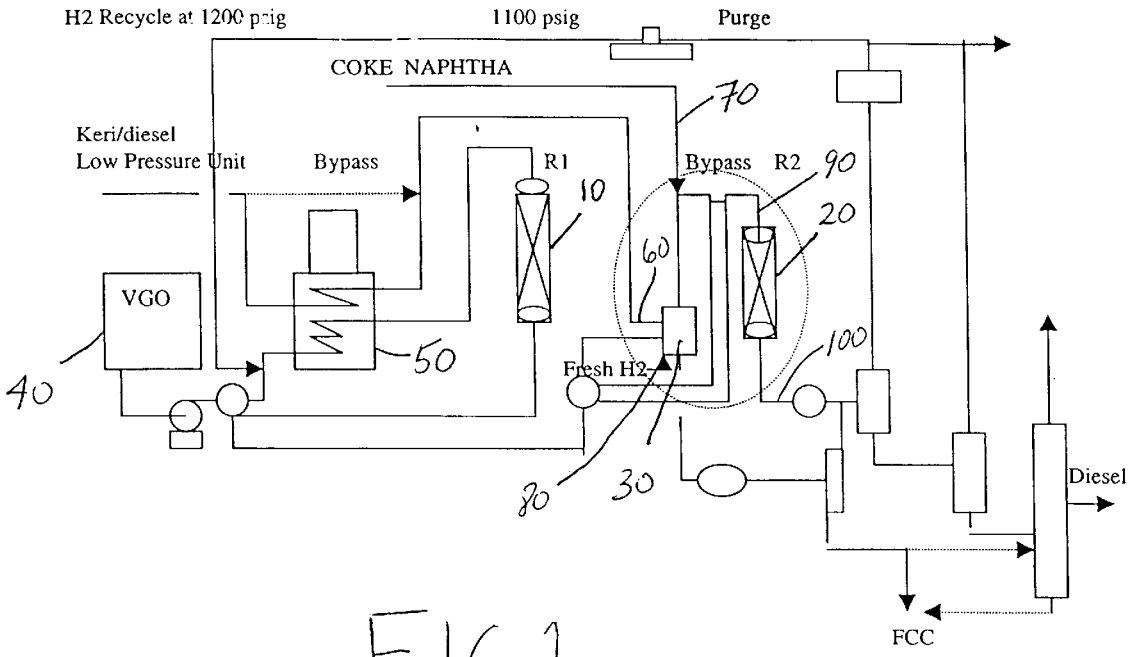
FIG. 1 schematically illustrates a system and process in accordance with the present invention.

The invention relates to a process for sequentially treating vacuum gas oil and Diesel so as to provide a final product fraction including components having satisfactorily low sulfur content and Diesel fractions having cetane numbers sufficiently improved to allow incorporation into the Diesel pools. The process utilizes a stripping and washing step to accomplish a high temperature and high pressure separation of an intermediate feedstock so as to avoid the need for intermediate compression and/or reheating of the feed to the hydrotreating stage.

As will be further discussed below, the process of the present invention advantageously maintains the pressure of the product of an initial step such as a hydrodesulfurization step through separation of that product into portions, and through feed of some portions into a subsequent step such as a hydrotreating step so as to provide the desired hydrodesulfurization and hydrotreating conditions and reactions without the need for multiple compressors and the like, and to provide more efficient energy utilization. Conventionally, the intermediate feed, for example from a VGO reactor product is cooled, and the pressure reduced, to provide a separate hydrogen rich phase and a hydrocarbon rich phase. This creates the need for additional compressors and/or heating equipment to re-pressurize and re-heat at least some portions of the intermediate feed.

One process in which the stripping and washing step of the present invention is particularly advantageous is a process for sequentially treating a vacuum gas oil/Diesel feedstock. In such a process, the initial feed—mainly composed of VGO—is preferably first treated in a hydrodesulfurization zone, and at least a portion of the hydrodesulfurization product is treated under high pressure and high temperature conditions utilizing a washing and stripping zone as discussed below so as to obtain a gas phase which can advantageously be passed to a hydrotreatment zone and a liquid phase which may suitably be fed to further processing such as fluid catalytic cracking and the like. The following description will be given in terms of this type of process. It should readily be appreciated, however, that the intermediate stripping and washing steps of the present invention would be readily applicable to other types of processes as well and can be varied without departing from the scope of the present invention.

Typical feed for the overall process of the present invention includes various distillate products, one suitable example of which is vacuum gas oil (VGO). VGO streams are readily available in refineries but frequently have unacceptably high sulfur content. These streams do include portions which can advantageously be converted into useful gasoline and Diesel fractions. Unfortunately, the Diesel fraction typically has a cetane number which is too low to be useful without further treatment.

Additional feedstocks which can find advantageous use in the overall process of the present invention include other refinery Diesel streams such as straight run Kerosene and Diesel, thermal cracked Diesel (for example from a delay coker) and the like, each of which typically has high sulfur content and a medium cetane number which will require improvement in order to be usefully added to the Diesel pool.

In accordance with the process of the present invention, a first reaction zone is established, preferably a hydrodesulfurization or HDS zone, for advantageously reducing sulfur content of the VGO feed and other distillates to acceptable levels. Product fractions from the HDS zone are used as reaction feed to a high pressure stripping and washing zone operating at substantially the same pressure as the outlet from the HDS step. The stripping and washing step, as will be discussed below, results in a gas phase advantageously containing hydrogen, naphtha, Diesel, light vacuum gas oil, C1–C4 hydrocarbons, $H_2S$ and $NH_3$ fractions, and a liquid phase including Diesel and light and heavy vacuum gas oil. The gas phase is advantageously still at a pressure and temperature which is sufficiently high that the gas phase can be fed directly to a second high pressure reaction zone, for example hydrotreating to improve the cetane number of the Diesel fraction, without the need for additional compressors or heaters and the like. Thus, the stripping and washing to provide the desired liquid and gas phase is advantageously carried out at substantially the same pressure as the hydrodesulfurization and hydrotreating steps. The pressure at the hydrodesulfurization or first stage, the separating stage and the hydrotreating or second stage may advantageously be between about 600 psig and about 1300 psig, more preferably between bout 700 psig and about 1300 psig. The pressure is preferably between about 650 psig and about 1250 psig at the hydrodesulfurization stage, and is maintained within about 50 psig of the pressure of the first stage reaction inlet through the stripping and washing and to the downstream reactor.

As set forth above, the feed to the hydrodesulfurization reactor is preferably a vacuum gas oil feed which has a sulfur content which must be reduced in order to allow the feed to be further treated and/or used as a fuel. The VGO feed may be heated before entering the HDS reactor, preferably to a temperature of between about 400° F. and about 750° F., and more preferably between about 500° F. and about 650° F. The VGO feed may be fed to the HDS reactor, or may be blended with other feed fractions such as cracked gasoline, hydrogen and the like, and fed to the reactor. In order to obtain the desired hydrodesulfurization, it is preferred that the HDS feed be a blend of VGO, cracked gasoline and hydrogen.

The HDS reactor may suitably be a conventional trickle bed reactor, preferably loaded with a catalyst suitable for enhancing the desired hydrodesulfurization and hydrodenitrogenation reactions. Such catalyst is well known to the person of ordinary skill in the art.

The product of the HDS reactor typically includes hydrogen, naphtha, Diesel, LVGO, HVGO, C1–C4 hydrocarbons, $H_2S$ and $NH_3$. This product stream, or at least a portion of the stream, is fed as a reaction feed to the high temperature and high pressure stripping and washing zone for separation into phases as desired in accordance with the invention.

At the stripping and washing zone, the reaction feed from the HDS reactor is preferably introduced into a stripping and washing reactor along with a stripping gas such as hydrogen and a washing feed or medium such as additional external feed of Diesel, LVGO and the like. Ideally, the reaction feed, washing feed and stripping gas are fed to the reactor each at different vertical heights, and the reactor has a gas phase outlet and a liquid phase outlet. The stripping gas serves to enhance high temperature and high pressure separation of sulfur and sulfur-containing compounds into the gas phase as $H_2S$. The hydrogen stripping also serves to enhance separation of the gas phase, and is itself present in the gas phase which is produced and which is useful as a feed to later treatment processes. In the HDS/hydrotreating example of the present invention, the gas phase product of the stripping and washing step preferably includes hydrogen, naphtha, Diesel, LVGO, C1–C4 hydrocarbons, $H_2S$ and $NH_3$.

The stripping and washing step also produces a liquid phase which is advantageously useful as feed to further treating such as fluid catalytic cracking and the like. In the HDS example of the present invention, this liquid phase may typically include Diesel, VGO and HVGO.

It should readily be appreciated that the stripping and washing steps of the present invention provide for advantageous separating of the gas and liquid phases, and the components present in each, without cooling and de-pressurization of the reaction feed and therefore does not require re-pressurization in order to be treated in subsequent high-pressure reactions.

It should also be noted that the use of externally obtained feed as a washing and/or as the stripping feed allows for the adjustment or fine-tuning of temperature in the stripping and washing reactor or zone, if desired. This is accomplished by feeding the external feed and/or stripping gas in greater or lesser amounts, and/or at different temperatures, so as to provide a desired resulting temperature of the combined mixture.

The stripping gas may suitably be hydrogen which is well suited for the desired stripping function and which can readily be recycled from the gas phase product of the stripping and washing step. Of course, other sources of hydrogen or other stripping gas could be used if desired.

The washing feed may suitably be Diesel, hydrotreated naphtha, LVGO or any other suitable washing substance, which could advantageously be provided from storage, from VGO liquid fractions separation (VGO), or from other treatment units such as DC, FCC, distillation, low pressure HDS units and other units or processes. In this regard, any of these sources could be regarded as external feed sources.

In accordance with the invention, the reaction feed, stripping gas and washing feed are preferably each fed to the stripping and washing zone in amounts sufficient to provide the desired separation of gas and liquid phases. In this regard, stripping gas may suitably be fed to the stripping and washing zone in an amount between about 10 and about 100 $ft^3$ of gas per barrel of reaction feed. Washing feed may advantageously be fed in an amount between bout 5% v/v and about 25% v/v with respect to the reaction feed.

It is particularly advantageous that the gas phase produced from the separating and washing step is produced at a pressure which is within about 50 psig of the pressure of the upstream or HDS reaction zone, and is further therefore still at a pressure sufficiently elevated that desirable second reactions such as hydrotreatment and the like can be carried out without needing to feed the gas phase to a compressor.

In accordance with the HDS/hydrotreating embodiment of the present invention, the gas phase from the stripper-separator is fed to a second reactor for carrying out hydrotreating so as to improve the cetane number of the Diesel fraction. The product of the hydrotreating reaction step includes a Diesel fraction having a cetane number which is substantially increased preferably by at least about 6 numbers, and a sulfur content of less than or equal to about 600 ppm, more preferably less than or equal to about 150 ppm. The gasoline fraction is provided having a sulfur content of less than or equal to about 150 ppm. Additional liquid product fractions from the separation-stripping-washing zone can advantageously be fractions suitable for further FCC processing and the like.

The second reactor may advantageously be a gas trickle bed hydrogenating reactor preferably containing effective amounts of a catalyst, preferably a sulfur-nitrogen resistant catalyst selective toward aromatic saturation and alkylparaffin forming reactions. Of course, the second reaction may be any desirable high pressure reaction, and the catalyst should be selected having activity toward the desired reaction.

Turning now to FIG. 1, a process in accordance with the present invention is schematically illustrated. FIG. 1 shows a first reactor 10 for carrying out a hydrodesulfurization reaction, a second reactor 20 for carrying out a hydrotreating reaction, and a high-pressure stripping and washing unit 30 connected between reactor 10 and reactor 20 for advantageously separating the product of reactor 10 into a high pressure gas phase for treatment in reactor 20 according to the invention, and a liquid phase for further treating such as FCC and the like.

As shown, the process advantageously begins through providing a VGO feed 40 which can be fed to a heater 50 if desired and which is then fed to first reactor 10. The converted Diesel product from first reactor 10 is conveyed through various stages and then as reaction feed to an inlet to stripping and washing unit 30, along with additional Diesel 60 from an external source, hydrotreated naphtha 70 and a feed of hydrogen 80 as stripping gas. This combination of components forms the feed blend to unit 30. Unit 30 produces a gas phase 90 containing, ideally, hydrogen, naphtha and Diesel fractions as well as LVGO, C1–C4 hydrocarbons, $H_2S$ and $NH_3$. The gas phase 90 or portions thereof, is then fed directly to second reactor 20 where Diesel fractions are subjected to hydrotreating so as to increase the cetane number as desired. Product 100 from second reactor 20 can then be separated into gasoline and other fractions which are useful either as is and/or in further FCC processes, and Diesel fractions which have acceptable sulfur content and sufficiently enhanced cetane number to be incorporated into Diesel pools as desired.

Still referring to FIG. 1, a portion of Diesel 60 may be separated off as fuel for heater 50, if desired, so as to provide for desired heating of the VGO feed. Of course, other heating mechanisms and methods could also be used.

In addition, hydrogen is in this embodiment separated from the gas phase of product of second reactor 20, preferably downstream of reactor 20, and is purged and recycled for mixing with VGO to form the feed blend for the HDS reactor 10.

The $H_2S$ and the $NH_3$ portions of the gas phase 90 can be separated prior to feed to reactor 20 if, desired.

A particular advantage of the present invention is that hydrodesulfurization reactor 10, hydrotreating reactor 20 and stripping/washing unit 30 are all operated at substantially the same pressure such that no additional compressor equipment is required along the process stream from first reactor 10 through unit 30 to second reactor 20. Thus, equipment and other overhead costs in connection with the process of the present invention are significantly reduced while end products are advantageously low in sulfur content while nevertheless including Diesel fractions possessing increased cetane number.

Figure 2:
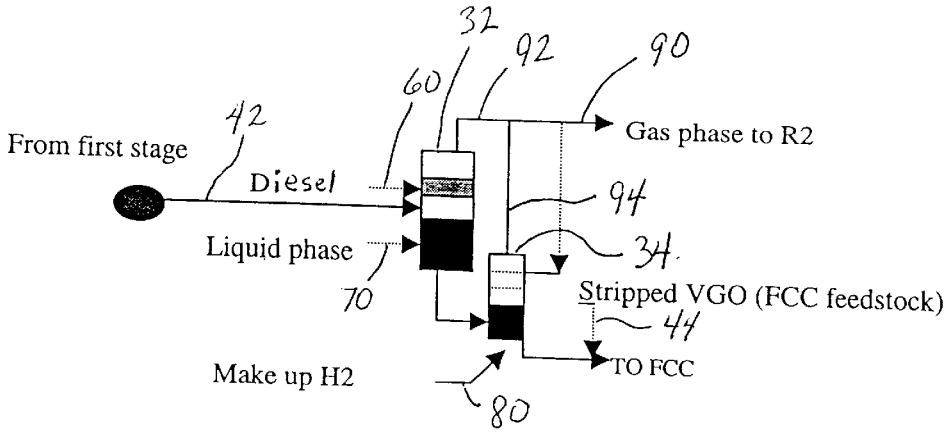
FIG. 2 further illustrates a portion of the schematic illustration of FIG. 1.

Referring now to FIG. 2, the stripping-washing stage of the present invention is further illustrated. Input to unit 30 includes external Diesel mixture 60 as a washing feed, a converted Diesel fraction 42 from first reactor 10 as a reaction feed, a liquid hydrotreated naphtha phase 70 and makeup hydrogen 80 as stripping gas. Also as shown, unit 30 may have two zones 32, 34, and the gas phase 92, 94 from each zone is advantageously combined to provide gas phase 90 for feed to second reactor 20 as desired. The product stream from separator 30 also includes stripped VGO 44 and other liquid products which are preferably conveyed to further FCC processing and the like.

The operating conditions for the HDS reactor 10 and hydrotreating reactor 20 are advantageously selected so as to maintain and utilize the pressure from reactor 10 in reactor 20 and thereby enhance efficiency and avoid the need for additional compressor equipment therebetween. The process operating conditions from reactor 10 may be selected based upon the characteristics of the feed, for example, and these operating conditions can then be determinative of the operating conditions in reactor 20. Table 1 set forth below provides examples of typical operating conditions for HDS reactor 10 (R1) and hydrotreatment reactor 20 (R2) for start of run (SOR) and end of run (EOR).

TABLE 1

| Condition | R1 SOR | R1 EOR | R2 SOR | R2 EOR |
|---|---|---|---|---|
| Pressure psig inlet/oulet | 1200/~1150 | 1200/~1100 | 1100 | 1050 |
| LHSV h-1 | 1 | 1 | 0.75–1.5 | 0.75–1.5 |
| Temperature | 350° C. | 390° C. | 330–350° C. | 360–380° |
| Beds with Quench | 2–3 | 2–3 | 2–3 | 2–3 |
| H2 partial pres. psig | 700-1100 | 700–1100 | 600–900 | 600–900 |

An example of typical feed for the HDS reactor for the process of the present invention is set forth below in Table 2.

TABLE 2

| | HCN | HCGO | AGO | LVGO | HVGO |
|---|---|---|---|---|---|
| API GRAVITY | 52.4 | 20.8 | 23 | 20.2 | 16.5 |
| NITROGEN, wppm | 280 | 4433 | 541 | 846 | 1513 |
| SULFUR, wt % | 1.23 | 3.80 | 2.00 | 2.30 | 2.70 |
| CONRADSON CARBON, wt % | — | 0.14 | 0.01 | 0.13 | 0.52 |
| DISTILLATION | TBP | TBP | TBP | TBP | TBP |
| IBP | 163 | 623 | 570 | 418 | 588 |
| 5 | 182 | 634 | 680 | 495 | 702 |
| 10 | 200 | 644 | 705 | 527 | 748 |
| 30 | 247 | 688 | 746 | 608 | 829 |
| 50 | 289 | 744 | 775 | 671 | 883 |
| 70 | 328 | 809 | 815 | 733 | 938 |
| 90 | 363 | 887 | 885 | 816 | 1011 |
| 95 | 380 | 911 | 927 | 859 | 1046 |
| FBP | 397 | 937 | 962 | 928 | 1067 |

As set forth above, the feeds to HDS reactor 10 and hydrotreating reactor 20 may typically include a blend of VGO, Diesel and other components. Table 3 below sets forth characteristics of a typical feed blend for HDS reactor 10 (R1) and hydrotreating reactor 20 (R2) in accordance with the present invention.

TABLE 3

| Reactor stages | R1 | R2 |
|---|---|---|
| INLET | VGO blend | Diesel blend |
| API GRAVITY | 16–22 | 28–33 |
| SULFUR, wt % | 1.0–3 | 0.02–2 |
| NITROGEN, wppm | 3000–15000 | 200–1500 |
| CONRADSON CARBON, wt % | 0.1–0.5 | — |
| BROMINE NUMBER, cg/g | 4–20 | 0.1–20 |
| METALS CONTENT (Ni + V) wppm | 0.01–4 | — |
| CETANE NUMBER | — | 20–40 |
| AROMATICS CONTENT, wt % | 3–50 | 20–75 |

As shown, the typical reactor feed to HDS reactor 10 will have an unacceptably high sulfur content, and the Diesel blend to hydrotreating reactor 20 will have a cetane number of between about 20 and about 40, which is unacceptable for incorporating into the Diesel pool.

Table 4 above sets forth characteristics of a typical VGO product from HDS reactor 11 (R1) and typical Diesel from hydrotreating reactor outlet 21 (R2) in accordance with the present invention.

TABLE 4

| Reactor stages | R1 | R2 |
|---|---|---|
| OULET | VGO blend | Diesel blend |
| API GRAVITY | 19–24 | 30–35 |
| SULFUR, wt % | 0.06–0.01 | 0.002–0.02 |
| NITROGEN, wppm | 200–600 | 10–70 |
| CONRADSON CARBON, wt % | 0.01–0.05 | — |
| BROMINE NUMBER, cg/g | ~0 | ~0 |
| METALS CONTENT (Ni + V) wppm | ~0 | — |
| CETANE NUMBER | — | 36–50 |
| AROMATICS CONTENT, wt % | 3–30 | 20–45 |

The final process product includes FCC fractions which advantageously have significantly reduced sulfur content, and Diesel fractions with reduced sulfur and cetane number-index which has been increased substantially thereby making the Diesel fraction acceptable for incorporation into the Diesel pool.

In light of the foregoing, it should be appreciated that a process has been provided for advantageously treating VGO and other Diesel feed so as to sequentially remove sulfur from the VGO feed and increase the cetane number of Diesel fractions in a process which is efficient in terms of both energy and equipment. The process therefore provides for converting readily available feeds into value end product.

Figure 3:
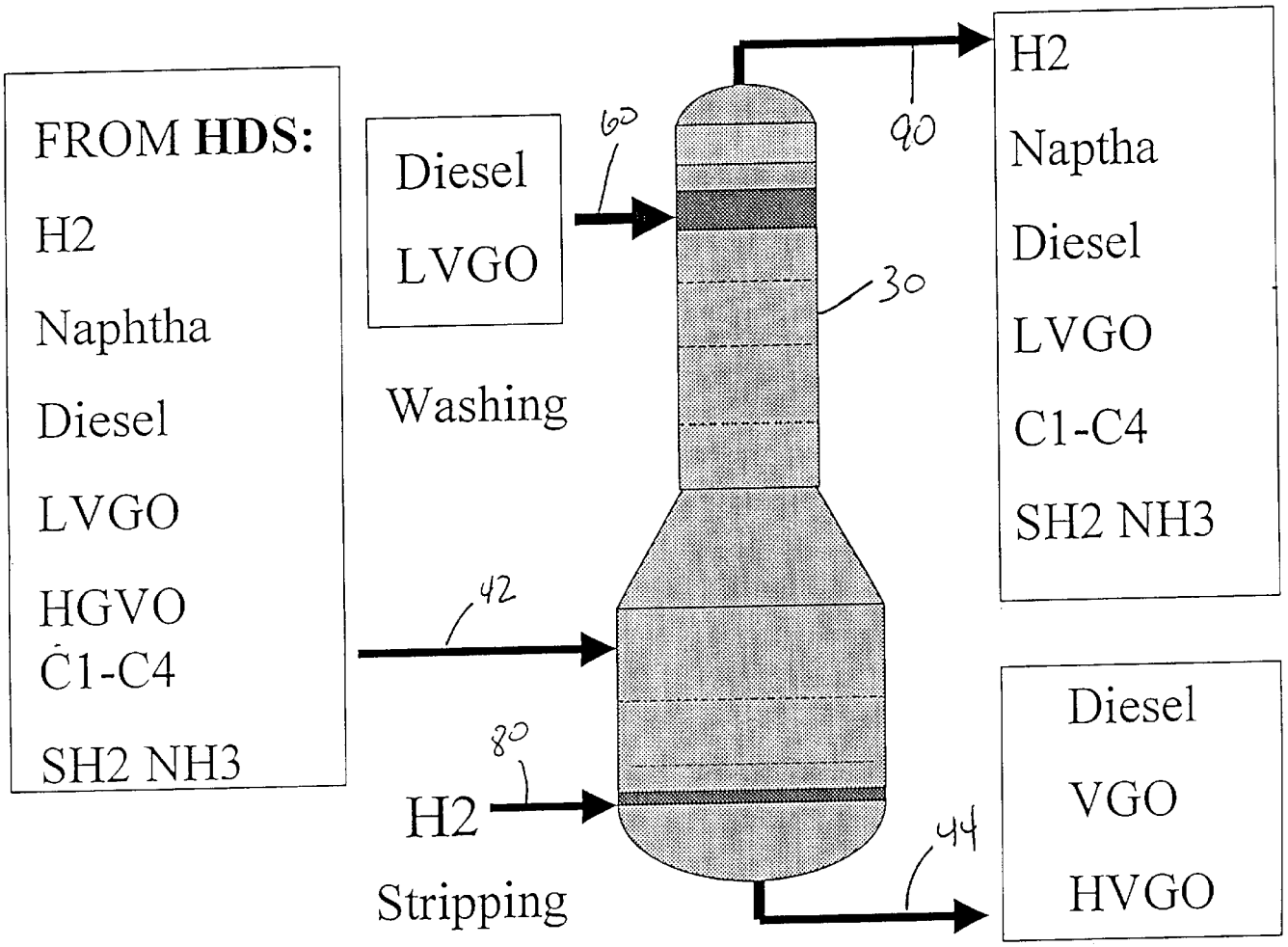
FIG. 3 illustrates the stripping and washing steps in accordance with one embodiment of the invention.
Figure 4:
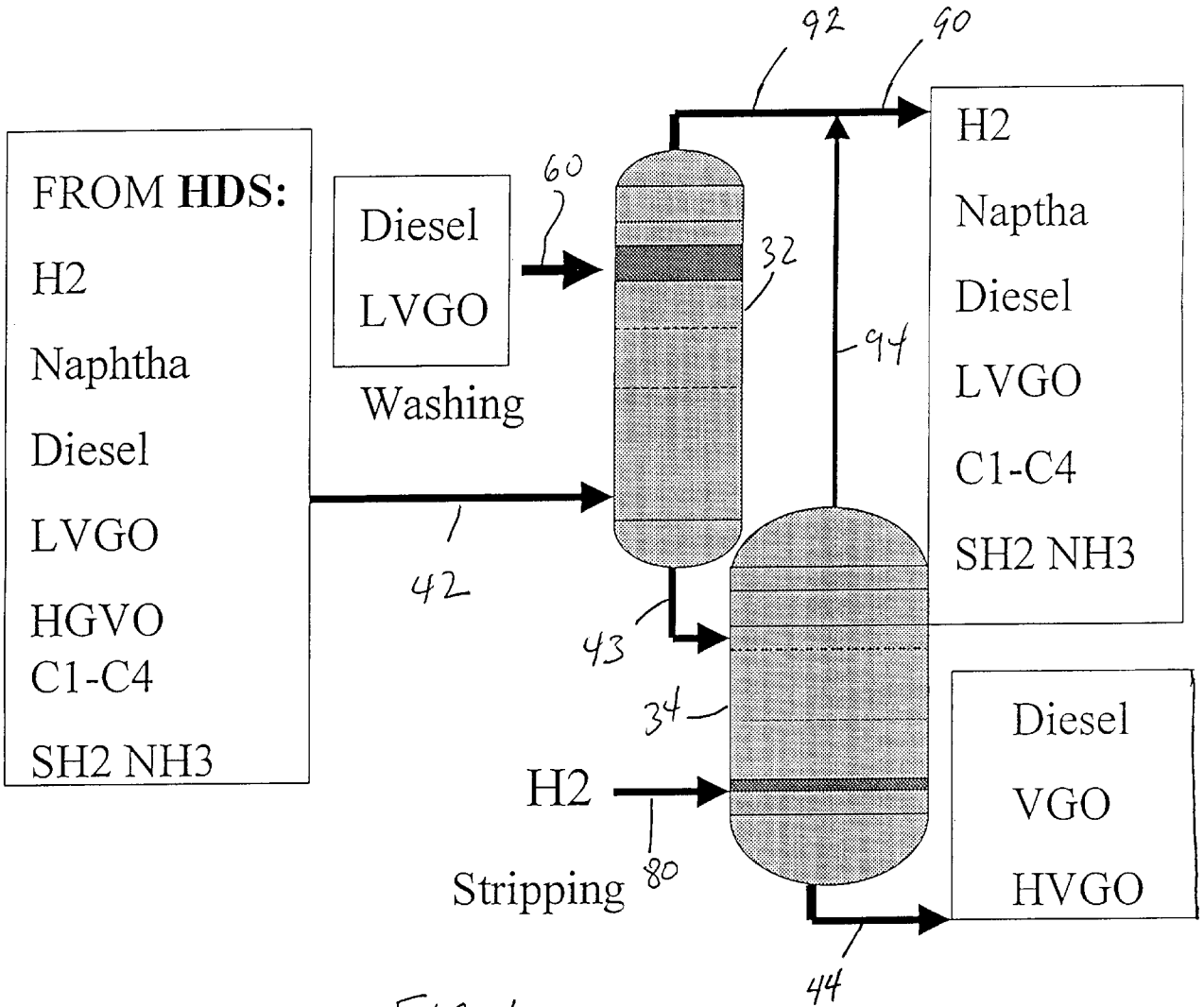
FIG. 4 illustrates the stripping and washing steps in accordance with another embodiment of the invention.
Figure 5:
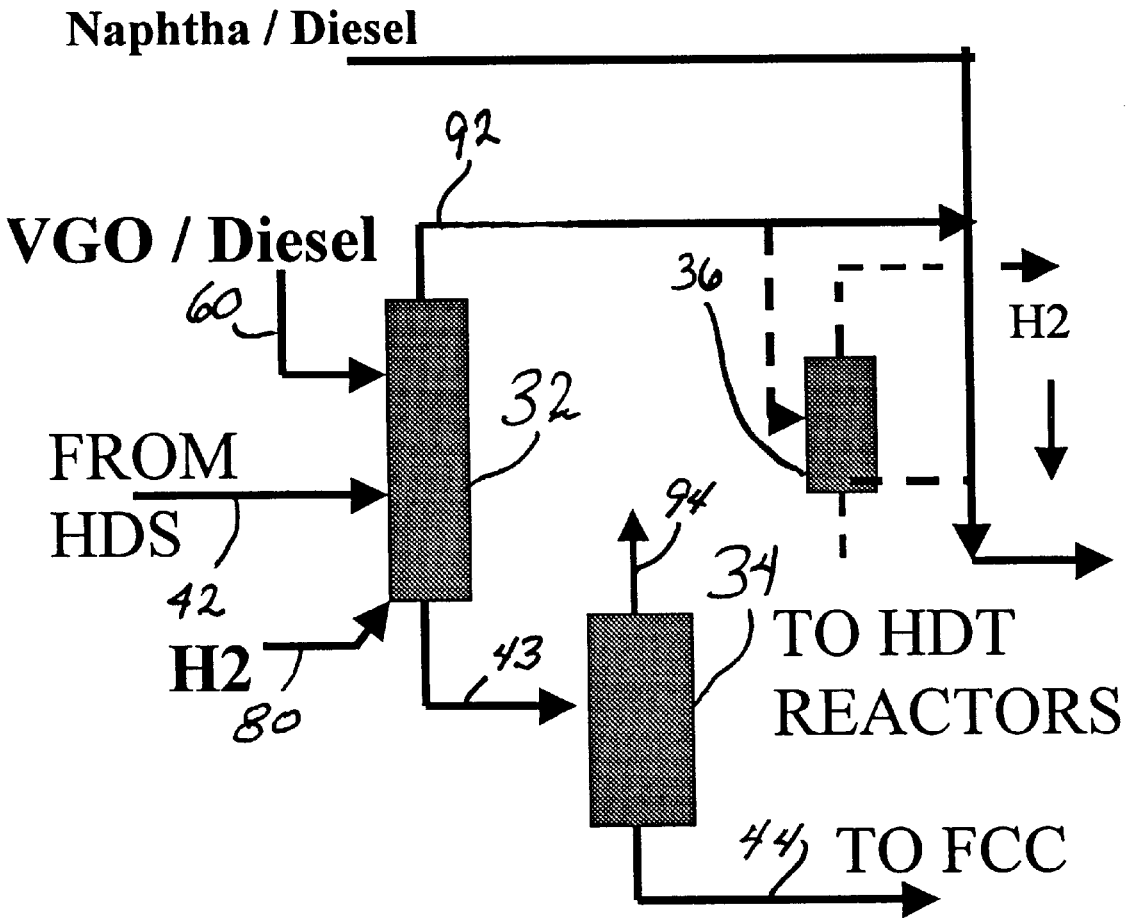
FIG. 5 illustrates still another embodiment of the stripping and washing steps of the present invention.

Turning now to FIGS. 3, 4 and 5, several additional embodiments of the stripping and washing steps of the present invention are further illustrated.

FIG. 3 shows a stripping and washing unit 30 in accordance with the present invention receiving a reaction feed from a hydrodesulfurization process (R1). The reaction feed, as shown, includes hydrogen, naphtha, Diesel, LVGO, HVGO, C1–C4 hydrocarbons and sulfur and ammonium contaminants. Reaction feed 42 is introduced into unit 30, typically at an intermediate vertical position such that stripping gas 80 can be introduced vertically lower than reaction feed 42, and washing feed 60 is introduced at a vertically higher position than reaction feed 42. Counter-current flow occurs within unit 30, with stripping gas 80 proceeding upwardly through the unit and external feed 60 flowing downwardly, each performing the desired function so as to assist in producing the desired separated gas phase 90 including hydrogen, naphtha, Diesel, LVGO, C1–C4, $H_2S$ and $NH_3$. Also produced is liquid portion 44 containing Diesel, VGO and particularly HVGO, which have substantially reduced sulfur content and which can advantageously be passed as feed to further processing, for example, fluid catalytic cracking.

Turning to FIG. 4, stripping and washing unit 30 in this embodiment is provided as two units 32, 34, with reaction feed 42 introduced into a lower portion of unit 32. Stripping gas 80 in this embodiment is fed to a lower portion of unit 34, and washing feed 60 is introduced to an upper portion of unit 32. This results in a similar counter-current flow in units 32 and 34 each resulting in a gas phase portion 92, 94 which is combined to form the desired gas phase 90 as discussed above. Further, liquid 43 exiting upstream unit 32 is introduced to downstream unit 34 and, after further stripping with stripping gas 80, results in liquid phase 44 suitable as feed for an FCC process and the like.

Turning now to FIG. 5, still another alternative embodiment of stripping and washing unit 30 is illustrated. As shown, reaction feed 42 is fed to unit 30 which in this embodiment is, like in FIG. 4, provided in two units 32, 34.

Washing feed 60 is introduced to unit 32 as shown, and stripping gas 80 in this embodiment is introduced to a lower portion of upstream unit 32. Unit 32 produces a gas phase 92 including the desired components as discussed above, and a liquid phase 43 which is fed to downstream unit 34. Unit 34 produces final liquid phase 44 which is suitable as feed to later processing for example FCC, and a gas phase 94 which could advantageously be mixed with gas phase 92 to produce final desired gas phase 90, or which could be otherwise disposed of. In this embodiment, the downstream reaction is a hydrotreating reaction or a second separator zone plus a hydrotreating reaction, and additional naphtha/Diesel is shown being mixed with gas phase 90 to produce the desired hydrotreating reaction feed.

FIG. 5 also illustrates a further embodiment of the process of the invention wherein gas phase 92 from unit 30 is fed to an additional high temperature and high pressure separation unit 36, with a gas phase 38 from unit 36 being fed to a further hydrotreatment reaction. Additional unit 36 serves to further enhance the separation of phases while still maintaining the desired temperature and pressure through to the downstream hydrotreatment reactor.

It should be readily appreciated that FIGS. 3, 4 and 5 illustrate variations of the stripping and washing steps which are all well within the broad scope of the present invention, and which all advantageously provide for high temperature and high pressure separation of a reaction feed into a gas phase and liquid phase containing the desired components for subsequent processing in on or two stages of hydrotreatment.

EXAMPLE 1

In order to illustrate the advantageous results obtained in accordance with the present invention, two processes were run sequentially carrying out a hydrodesulfurization reaction (VGO reactor) and a sequential hydrotreating reaction. In the first or conventional process, a naphtha, Diesel and VGO feed was treated in a hydrodesulfurization unit to upgrade quality and produce a reaction feed, and this reaction feed was passed to a conventional hydrotreating zone.

In the second process, VGO is fed to a hydrodesulfurization zone (R1) operated at the same conditions so as to produce a reaction feed for a separation-washing-stripping zone, and this reaction feed was mixed with hydrogen stripping gas and washing Diesel according to the invention. The washing and stripping step resulted in a gas phase containing hydrogen, naphtha, Diesel, LVGO, C1–C4 hydrocarbons, $H_2S$ and $NH_3$, as well as a liquid phase containing Diesel, VGO and HVGO. The pressure of the gas phase was within about 50 psig of the pressure of the reaction feed produced from the hydrodesulfurization reactor (R1). This gas phase was blended with external naphtha and a Diesel fraction before entering a hydrotreating reactor and resulted in production of a final product which was compared to that of the conventional process.

Table 5 sets forth the results of this process, identifying the conventional process as "without SEHP", and the process of the present invention as "with SEHP". Notice that the conventional process treats all feed in the VGO section without further hydrotreating as it is well known in previous art.

TABLE 4

| | Without SEHP* | With SEHP** |
|---|---|---|
| Naphtha HDS wt % | 90 | 99 |
| Diesel HDS wt % | 88 | 98 |
| Diesel Aromatics Reduction wt % | 20 | 34 |
| Delta Diesel CI | 2 | 6–8 |
| VGO HDS | 97 | 97 |
| 650° F.+ Conversion | 10 | 16 |

*Feed to HDS: (Naphtha + Diesel + VGO)
**Feed to HDS: (VGO, Feed to HDT Naphtha + Diesel)

As shown, the process conducted without high temperature and high pressure stripping and washing (without SEHP) did substantially reduce sulfur content and Diesel aromatics, and did provide marginal improvement in the cetane number even when treated at high pressure. However, the process carried out utilizing SEHP resulted in a 99% reduction in weight of sulfur contaminants in the naphtha fraction, a 98% reduction by weight of sulfur content in the Diesel, and much greater reduction of Diesel aromatics, and a substantial increase in cetane number improvement. The process in accordance with the present invention also experienced a greater conversion rate for the 650° F.+ fraction.

EXAMPLE 2

In order to further illustrate the advantageous results obtained in accordance with the present invention, two modes of application of the sequential processes were run with the same hydrodesulfurization reaction stage but different hydrotreating stages. SEHP 1 is one mode where the gas phase produced in the stripping-washing separation stage is blended with 20% vol. external diesel and 15% vol. naphtha fraction and sent to the hydrotreating reactor. In the second process or mode (SEHP2) the gas phase is cooled to 560° F. and sent to a second high pressure separator system operating at substantially the same pressure as the previous one. The liquid phase leaving the second high pressure separator at substantially the same pressure, is reheated by blending with 20% vol. external diesel fraction and with fresh hydrogen, and is sent to the trickle bed hydrotreating stage. The gas phase at substantially the same pressure, produced in the second separator, is blended with 10% volume of external naphtha and sent to a gas phase reactor for hydrotreating. The reactor effluent from gas phase and trickle bed hydrotreating reactors are combined and sent to a low pressure separation stage. Table 6 sets forth the results of this process, identifying the SEHP1 process with one hydrotreating stage and "SEHP2" as the two stage hydrotreating process. Notice that both schemes use the same HDS stage and the same stripping washing separator stage

TABLE 6

| | SEHP1 | SEHP2 |
|---|---|---|
| Naphtha HDS wt % | 99 | 99.9 |
| Diesel HDS wt % | 98 | 98.7 |
| Diesel Aromatics Reduction wt % | 34 | 40 |
| Delta Diesel CI | 7 | 10 |
| VGO HDS | 96 | 96 |
| 650° F.+ Conversion | 15.5 | 17 |

As shown, the process conducted with high pressure stripping and washing and one hydrotreating stage accomplished an important reduction in sulfur content and Diesel aromatics, and also a substantial improvement in the cetane number. However, the process carried out utilizing two hydrotreating stages resulted in a greater sulfur and aromatic reduction, and much greater increase in cetane number. The SEHP2 mode also experienced a greater conversion rate for the 650° F.+ fraction.

EXAMPLE 3

Tables 7 and 8 below set forth further examples of washing and stripping in accordance with the present invention.

TABLE 7

| | | Conventional Separation System @ 570° F. | | Stripping with $H_2$ 570° F. | |
|---|---|---|---|---|---|
| Flow lb/hr | | 1022885 | | 1021822 | |
| Temperature $H_2$ (MMSCFD) | | None | | 15.0 | |
| | Feed | Top | Bottom | Top | Bottom |
| Rate lb/hr | | | | | |
| Temperature ° F. | | 570 | 570 | 570 | 570 |
| Pressure, psig | | 1050 | 1050 | 1050 | 1050.2 |
| | From R1 | Gas phase | Liquid Phase | Gas phase | Liquid Phase |
| Fraction % wt | | | | * | |
| 147° F. | 14.84 | 14.60 | 0.24 | 14.66 | 0.18 |
| 147–300° F. | 4.96 | 4.07 | 0.89 | 4.17 | 0.79 |
| 300–500° F. | 6.02 | 3.66 | 2.36 | 3.68 | 2.35 |
| 500–650° F. | 13.91 | 3.28 | 10.63 | 3.30 | 10.61 |
| 650–800° F. | 24.36 | 1.36 | 23.00 | 1.33 | 23.03 |
| 800+° F. | 35.91 | 0.22 | 35.69 | 0.22 | 34.69 |

*does not include added H2

TABLE 8

| | | Stripping with $H_2$ washing with VGO | | Stripping with $H_2$ washing with Diesel | |
|---|---|---|---|---|---|
| Flow lb/hr | | 1025379 | | 1019427 | |
| Temperature $H_2$ (MMSCFD) | | | | 15.0 | |
| VGO/Diesel BDP | | 2400/0 | | 0/4800 | |
| | Feed | Top | Bottom | Top | Bottom |
| Rate lb/hr | | | | | |
| Temperature ° F. | | 570 | 570 | 570 | 570 |
| Pressure, psig | | 1050 | 1050 | 1050 | 1050.2 |
| | R1 outlet | Gas phase | Liquid Phase | Gas phase | Liquid Phase |
| Fraction % wt | | | | | |
| 147° F. | 15.05 | 14.88 | 0.17 | 14.96 | 0.07 |
| 147–300° F. | 4.95 | 4.49 | 0.47 | 4.55 | 0.40 |
| 300–500° F. | 6.01 | 4.90 | 1.11 | 5.14 | 0.97 |
| 500–650° F. | 13.87 | 5.08 | 8.79 | 5.86 | 8.01 |
| 650–800° F. | 24.30 | 3.36 | 20.94 | 2.24 | 22.06 |
| 800+° F. | 35.82 | 0.68 | 35.14 | 0.05 | 35.78 |

Table 7 shows the effect of hydrogen stripping associated to more gas phase production. The H,S and ammonia is stripped from VGO to the gas phase.

Table 8 shows the washing effect using or VGO or Diesel. The results obtained indicate more light material and less heavy material carryover in the gas phase. Washing with VGO or diesel also controls the gas phase temperature.

This invention may be embodied in other forms or carried out in other ways without departing from the spirit or essential characteristics thereof. The present embodiment is therefore to be considered as in all respects illustrative and not restrictive, the scope of the invention being indicated by the appended claims, and all changes which come within the meaning and range of equivalency are intended to be embraced therein.

What is claimed is:

1. A process for treating a vacuum gas oil and Diesel feed, comprising the steps of:

providing a reaction feed containing vacuum gas oil, Diesel and sulfur-containing compounds;

providing a stripping gas;

providing a washing feed; and mixing said reaction feed, said stripping gas and said washing feed in a stripping and washing zone so as to obtain a gas phase containing said sulfur-containing compounds and a liquid phase substantially free of said sulfur-containing compounds, wherein said reaction feed is provided at a reaction feed pressure of between about 700 psig and about 1300 psig, and wherein said stripping and washing zone is operated at a pressure within about 50 psig of said reaction feed pressure, wherein said washing feed comprises at least one of Diesel, light vacuum gas oil and mixtures thereof produced in the process or added from external source.

2. The process according to claim 1, wherein said reaction feed comprises hydrogen, naphtha, Diesel, light vacuum gas oil, heavy vacuum gas oil, C1–C4 hydrocarbons, $H_2S$ and $NH_3$, and wherein said liquid phase comprises Diesel and heavy vacuum gas oil.

3. The process according to claim 1, wherein said stripping gas is hydrogen gas.

4. The process according to claim 1, wherein said washing feed is obtained from an external source.

5. The process according to claim 1, wherein said washing feed comprises Diesel and a light vacuum gas oil fraction.

6. The process according to claim 1, wherein said gas phase is provided at a pressure within about 50 psig of said reaction feed pressure.

7. The process according to claim 1, wherein said reaction feed is a product of a hydrodesulfurization reaction, and wherein said gas phase is provided as feed to a hydrotreating reaction zone.

8. The process according to claim 7, wherein said gas phase is blended with an external naphtha and diesel fraction at substantially the same pressure as said gas phase to provide a combined phase, and wherein said combined phase is provided as feed to said hydrotreating reaction zone.

9. The process according to claim 8, wherein said liquid phase is provided as feed to a fluid catalytic cracking reaction.

10. The process according to claim 8, further comprising maintaining said gas phase at a pressure within about 50 psig of said reaction feed pressure from said stripping and washing zone to said hydrotreating reaction zone, whereby compressors are not required between said stripping and washing zone and said hydrotreating reaction zone.

11. The process according to claim 1, wherein said reaction feed is provided at a reaction feed temperature, and further comprising the steps of providing at least one of said stripping gas and said washing feed at a temperature different from said reaction feed temperature, and mixing said reaction feed, said stripping gas and said washing feed in proportions selected to provide a desired resulting temperature.

12. The process according to claim 1, wherein said stripping gas is mixed with said reaction feed at a ratio of said stripping gas to said reaction feed of between about 10 and about 100 $ft^3$ of gas per barrel of feed.

13. The process according to claim 1, wherein said washing feed is mixed with said reaction feed in an amount between about 5% v/v and about 25% v/v with respect to volume of said reaction feed.

14. The process according to claim 1, wherein said stripping and washing zone comprises a reactor having an inlet for said reaction feed, wherein said stripping gas is fed to said reactor below said inlet, and wherein said washing feed is fed to said reactor above said inlet.

* * * * *